US006669469B2

(12) United States Patent
Suzuki et al.

(10) Patent No.: US 6,669,469 B2
(45) Date of Patent: Dec. 30, 2003

(54) CATALYST COMBUSTION DEVICE AND METHOD OF PRODUCING FRAME BODY PORTION THEREOF

(75) Inventors: Motohiro Suzuki, Osaka (JP); Tatsuo Fujita, Osaka (JP); Tetsuo Terashima, Neyagawa (JP); Toshiaki Ando, Otsu (JP); Narito Yamaguchi, Ritto (JP); Yukio Watanabe, Kyoto (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/258,366

(22) PCT Filed: Feb. 20, 2002

(86) PCT No.: PCT/JP02/01442

§ 371 (c)(1),
(2), (4) Date: Jan. 13, 2003

(87) PCT Pub. No.: WO02/066894

PCT Pub. Date: Aug. 29, 2002

(65) Prior Publication Data

US 2003/0157448 A1 Aug. 21, 2003

(30) Foreign Application Priority Data

Feb. 21, 2002 (JP) ..... 2001-044727

(51) Int. Cl.[7] ..... F23D 11/44; F23D 14/18

(52) U.S. Cl. ..... 431/328; 431/7; 431/11; 431/3

(58) Field of Search ..... 431/7, 11, 170, 431/326, 328, 207, 3

(56) References Cited

U.S. PATENT DOCUMENTS

| | | | | | |
|---|---|---|---|---|---|
| 5,901,700 | A | * | 5/1999 | Suzuki et al. | 431/7 |
| 5,938,427 | A | | 8/1999 | Suzuki et al. | |
| 6,386,862 | B1 | * | 5/2002 | Fujita et al. | 431/170 |

FOREIGN PATENT DOCUMENTS

| | | | | |
|---|---|---|---|---|
| DE | 44 38 356 | * | 5/1996 | 431/328 |
| EP | 0716263 B1 | | 6/1996 | |
| JP | 57-47119 | * | 3/1982 | 431/7 |
| JP | 57-101207 | | 6/1982 | |
| JP | 59-167616 | * | 9/1984 | 431/11 |
| JP | 59-180209 | * | 10/1984 | 431/11 |
| JP | 60-66005 | * | 4/1985 | 431/11 |
| JP | 62-299610 | | 12/1987 | |
| JP | 05-306808 | * | 11/1993 | 431/7 |
| JP | 06-221513 | * | 8/1994 | 431/7 |
| JP | 07-190646 | | 7/1995 | |
| JP | 08-100908 | | 4/1996 | |
| JP | 09-033007 | | 2/1997 | |
| JP | 09-280517 | | 10/1997 | |
| JP | 11-51333 | * | 2/1999 | 431/7 |
| JP | 11-182869 | | 7/1999 | |
| JP | 2000-146298 | | 5/2000 | |
| JP | 2000-266316 | * | 9/2000 | 431/7 |

OTHER PUBLICATIONS

Japanese search report for PCT/JP02/01442 dated Apr. 23, 2002.
English translation of Form PCT/ISA/210.

* cited by examiner

*Primary Examiner*—Carl D. Price
(74) *Attorney, Agent, or Firm*—RatnerPrestia

(57) ABSTRACT

A low-cost, high-mass-productivity catalytic combustion apparatus having a construction that permits easy maintenance is realized. There is provided a catalytic combustion apparatus in which, by means of a combustion chamber having a fuel supply portion 1 and a combustion air supply portion on the upstream side thereof and a combustion gas exhaust port on the downstream side thereof and a catalytic combustion portion with an upstream surface and a downstream surface provided in the combustion chamber, the upstream surface and the downstream surface being substantially parallel to each other, a fuel-air mixture supplied to the interior of the combustion chamber is caused to react to liberate heat. The catalytic combustion apparatus includes a heat exchange portion, which constitutes part of walls of the combustion chamber, and a fin-type radiant heat-receiving portion, which protrudes from the heat exchange portion into the combustion chamber and being provided in the vicinity of the catalytic combustion portion. In this catalytic combustion apparatus, the surface of the fin-type radiant heat-receiving portion and the surface of the heat exchange portion face in the same direction.

20 Claims, 3 Drawing Sheets

CATALYST COMBUSTION DEVICE AND METHOD OF PRODUCING FRAME BODY PORTION THEREOF

THIS APPLICATION IS A U.S. NATIONAL PHASE APPLICATION OF PCT INTERNATIONAL APPLICATION PCT/JP02/01442.

TECHNICAL FIELD

The present invention relates to a low-cost, high-mass-productivity catalytic combustion apparatus having a construction that permits easy maintenance.

BACKGROUND ART

Many proposals have so far been made about the construction of a catalytic combustion apparatus having a heat exchanger portion. For example, as described in Japanese Patent Laid-Open No. 2000-146298, many conventional catalytic combustion apparatuses comprise a combustion chamber 2, a radiant heat-receiving portion (fin) 3, a passage 4 for a fluid to be heated, which supports the radiant heat-receiving portion, and catalytic bodies 5, 7.

In such a conventional catalytic combustion apparatus, the radiant heat-receiving portion 3 is arranged parallel to the flow of a combustion gas in order to improve the heat exchange efficiency, but the passage 4 which supports the radiant heat-receiving portion is vertical to the flow. With this construction, after forming the radiant heat-receiving portion 3 and the passage 4 that supports the radiant heat-receiving portion as separate parts, it is necessary to employ the step of press fitting, brazing or the like in order to install the radiant heat-receiving portion 3 in the passage 4.

Or after the extrusion modeling of the passage 4 and radiant heat-receiving portion 3 as an integral component part, the number of steps tends to increase due to the necessity of adopting the step of cutting, punching or the like in order to remove the radiant heat-receiving portion 3 near the position where the catalytic body 5 is to be installed. For this reason, there were problems of high cost and low mass productivity.

Furthermore, it is difficult to automate the steps of brazing etc. and labor costs tend to increase. For this reason, also in this respect, there were problems of high cost and low productivity.

DISCLOSURE OF THE INVENTION

The object of the invention is to solve the above-described problems with the conventional catalytic combustion apparatus.

One aspect of the present invention is a catalytic combustion apparatus in which, by means of a combustion chamber having a fuel supply portion and a combustion air supply portion on the upstream side thereof, and a combustion gas exhaust port on the downstream side thereof and a catalytic combustion portion with an upstream surface and a downstream surface provided in said combustion chamber, said upstream surface and said downstream surface being substantially parallel to each other, a fuel-air mixture supplied to the interior of said combustion chamber is caused to react to liberate heat, characterized in that said catalytic combustion apparatus comprises a heat exchange portion, said heat exchange portion constituting part of walls of said combustion chamber and a fin-type radiant heat-receiving portion, said fin-type radiant heat-receiving portion protruding from said heat exchange portion into said combustion chamber, and being provided in the vicinity of said catalytic combustion portion, and characterized in that at least the surface of said fin-type radiant heat-receiving portion and the surface of said heat exchange portion each face in the same direction.

Another aspect of the present invention is the catalytic combustion apparatus, characterized in that said catalytic combustion apparatus further comprises a convective heat transfer portion, said convective heat transfer portion being provided on the downstream side of said catalytic combustion portion so as to protrude from said heat exchange portion into said combustion chamber and having a surface facing substantially in the same direction as the surface of said radiant heat-receiving portion.

Still another aspect of the present invention is the catalytic combustion apparatus, characterized in that said heat exchange portion, said radiant heat-receiving portion and said convective heat transfer portion are integrally formed by extrusion modeling.

Yet still another aspect of the present invention is the catalytic combustion apparatus, characterized in that a surface on the side of the catalytic combustion portion, of a catalyst support which supports said catalytic combustion portion faces substantially in the same direction as the surface of said radiant heat-receiving portion.

Still yet another aspect of the present invention is the catalytic combustion apparatus, characterized in that also the surface of said catalytic combustion portion faces in the same direction as the surface of said radiant heat-receiving portion.

A further aspect is the catalytic combustion apparatus, characterized in that said catalytic combustion apparatus further comprises a heat medium passage through which a heat medium flows and a support of heat medium passage which supports the heat medium passage, and in that said support of heat medium passage is provided on said heat exchange portion so that the direction of flow of the heat medium in said heat medium passage is substantially parallel to the surface of said catalytic combustion portion.

A still further aspect of the present invention is the catalytic combustion apparatus, characterized in that the surface on the side of said catalytic combustion portion of said heat exchange portion is covered with a heat resistant coating of emissivity of about 1.

A yet further aspect of the present invention is the catalytic combustion apparatus, characterized in that said catalytic combustion apparatus further comprises a vaporizing portion which vaporizes a liquid fuel, and in that said radiant heat-receiving portion is disposed on the downstream side of said catalytic combustion portion.

A still yet further aspect of the present invention is the catalytic combustion apparatus, characterized in that upstream of said catalytic combustion portion is provided a tar holdback plate which covers the surface on the side of said catalytic combustion portion of said heat exchange portion, and which is formed from a material having a thermal conductivity smaller than that of a substrate of said heat exchange portion.

An additional aspect of the present invention is the catalytic combustion apparatus, characterized in that between said tar holdback plate and said heat exchange portion is provided a tar holdback plate support which comes into partial contact with both of said tar holdback plate and said heat exchange portion.

A still additional aspect of the present invention is the catalytic combustion apparatus, characterized in that at least one of the two walls among walls forming said combustion chamber, the two walls being substantially vertical to the surface of said radiant heat-receiving portion, is detachable.

A yet additional aspect of the present invention is the catalytic combustion apparatus, characterized in that at least one of said walls is formed from a metal or coated with a metal oxide film.

A still yet additional aspect of the present invention is the catalytic combustion apparatus, characterized in that there is provided a passage partition plate which is substantially parallel to the upstream surface of said catalytic combustion portion.

A supplementary aspect of the present invention is the catalytic combustion apparatus, characterized in that said passage partition plate and said wall are integrated.

A still supplementary aspect of the present invention is a method of manufacturing a casing portion of a catalytic combustion apparatus in which, by means of a combustion chamber having a fuel supply portion and a combustion air supply portion on the upstream side thereof and, a combustion gas exhaust port on the downstream side thereof and a catalytic combustion portion with an upstream surface and a downstream surface provided in said combustion chamber, said upstream surface and said downstream surface being substantially parallel to each other, a fuel-air mixture supplied to the interior of said combustion chamber is caused to react to liberate heat, characterized in that said casing portion comprises a heat exchange portion, said heat exchange portion constituting part of walls of said combustion chamber, a fin-type radiant heat-receiving portion, said fin-type radiant heat-receiving portion protruding from said heat exchange portion into said combustion chamber and being provided in the vicinity of said catalytic combustion portion, and a convective heat transfer portion, said convective heat transfer portion being provided on the downstream side of said catalytic combustion portion so as to protrude from said heat exchange portion into said combustion chamber and having a surface facing substantially in the same direction as the surface of said radiant heat-receiving portion, in that the surface of said fin-type radiant heat-receiving portion, the surface of said heat exchange portion and the surface of said convective heat transfer portion all face in the same direction, and in that said fin-type radiant heat-receiving portion, said heat exchange portion and said convective heat transfer portion are integrally formed by extrusion modeling.

DESCRIPTION OF SYMBOLS

Figure 1A:
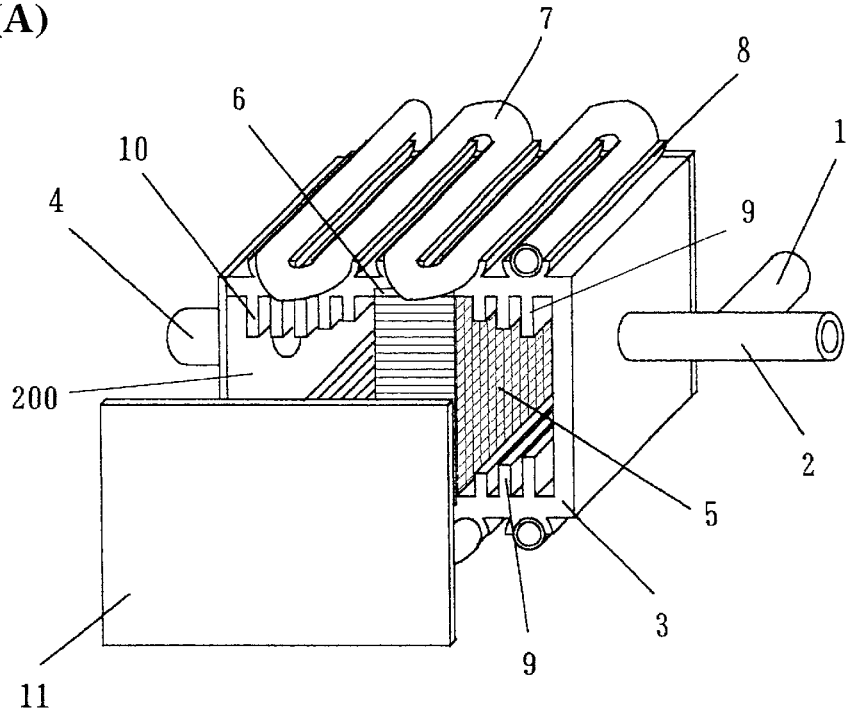
FIGS. 1(A)–(C) are perspective views of a catalytic combustion apparatus in the first embodiment of the invention.

1 Fuel supply line
2 Air supply line
3 Heat exchange portion
4 Exhaust port
5 Catalytic combustion portion
6 Catalyst support
7 Heat medium passage
8 Heat medium passage support
9 Radiant heat-receiving portion
10 Convective heat transfer portion
11 Side plate of heat exchange portion
12 First passage partition plate
13 Second passage partition plate
14 Opening of first passage partition plate
15 Opening of second passage partition plate
16 Vaporizing portion
17 Tar holdback plate
18 Flow equalizing plate
100 Seal
200 Combustion chamber

BEST MODE FOR CARRYING OUT THE INVENTION

Embodiments of the invention will be described below by referring to drawings. Carrying out the invention requires a catalytic combustion portion having air permeability and oxidation activity for various types of fuels, an ignition device, a flow controller, a fuel-air mixer and, as required, a liquid fuel vaporizer, a temperature detector, a drive unit, etc.

It is possible to use as the catalytic combustion portion, those which are configured in such a manner that active components containing, as main components, noble metals, such as platinum and palladium, are supported by a metallic or ceramic honeycomb carrier, braided ceramic fibers, a porous sintered compact, etc.

Furthermore, a manual needle valve, a motor-driven solenoid valve, etc. are used for the flow control of air and gaseous fuels and a solenoid pump etc. are used in the case of liquid fuels.

For other drive portions, manual lever operation, automatically-controlled motor drive, etc. are possible, and an electric heater, a spark ignition device, etc. can be used as the ignition unit.

Incidentally, all these devices have conventionally been widely adopted and other known means are also possible.

Embodiment 1

Figure 1B:
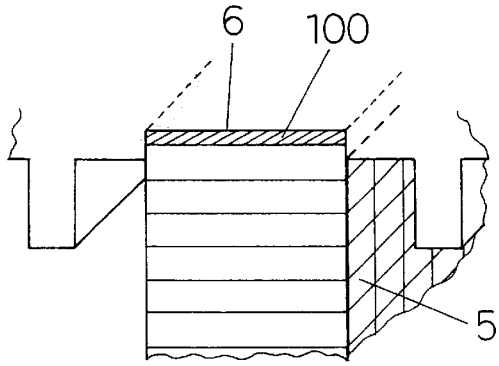
Figure 1C:
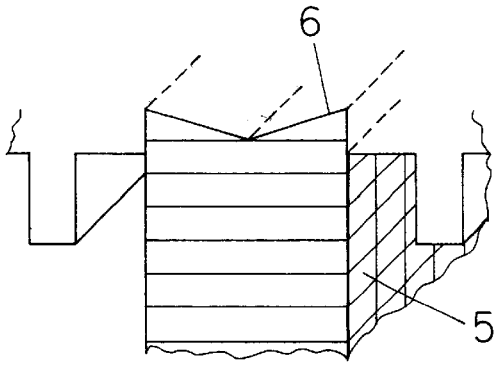

FIGS. 1(A)–1(C) are perspective views of the first embodiment of a catalytic combustion apparatus related to the invention. In FIG. 1(A), the numeral 1 indicates a fuel supply line, the numeral 2 an air supply line, the numeral 3 a heat exchange portion, and the numeral 4 an exhaust port. Furthermore, the numeral 5 indicates a catalytic combustion portion, in which a ceramic honeycomb having air permeability supports platinum-group metals, the numeral 6 indicates a catalyst support, which fixes the catalytic combustion portion 5 in position. Moreover, the numeral 7 indicates a heat medium passage, and the numeral 8 indicates a support of heat medium passage, which supports the heat medium passage 7 by coming into contact therewith. port. Furthermore, the numeral 5 indicates a catalytic combustion portion, in which a ceramic honeycomb having air permeability supports platinum-group metals, the numeral 6 indicates a catalyst support, which fixes the catalytic combustion portion 5 in position. Moreover, the numeral 7 indicates a heat medium passage, and the numeral 8 indicates a support of heat medium passage, which supports the heat medium passage 7 by coming into contact therewith.

Also, the numeral 9 indicates a fin-type radiant heat-receiving portion, which protrudes to the inside of the heat exchange portion 3, and the numeral 10 indicates a convective heat transfer portion. Furthermore, the numeral 11 indicates a side panel of heat exchange portion, which can be attached to and detached from the end surface of the heat exchange portion 3. Incidentally, in this embodiment, the heat exchange portion 3 and the side plate of heat exchange portion 11 mainly constitute a combustion chamber 200.

Next, the operation and characteristics of this embodiment will be described with reference to FIG. 1(A). A fuel (a city gas in this case) which is supplied through the fuel supply line 1 is mixed with air, which has passed through the air supply line 2, and is then supplied to the interior of the heat exchange portion 3.

Furthermore, the fuel-air mixture is supplied to the catalytic combustion portion 5, where an oxidation reaction occurs. Due to the heat of this reaction, the upstream temperature of the catalytic combustion portion 5 is controlled to not less than 600° C. at which good combustion waste gas characteristics are ensured and to not more than 900° C. which is the heat-resistant limit of the catalytic material. At this time, the downstream temperature is 350° C. to 650° C.

The radiant heat from the upstream and downstream sides of this catalytic combustion portion 5 is received by the radiant heat-receiving portion 9, is conducted through the heat exchange portion 3, passes through the support of heat medium passage 8, and is transmitted to a heat medium flowing through the heat medium passage 7. A combustion waste gas after the oxidation reaction performs heat exchange by repeating contact with the conductive heat transfer portion 10 and is eventually exhausted from the exhaust port 4 after reaching temperatures of 50° C. to 200° C.

The surface of the radiant heat-receiving portion 9, the surface of the heat exchange portion 3, the surface of the catalyst support 6 and the surface of the support of heat medium passage support 8 all face in the same direction. Incidentally, "the same direction" here does not always mean a parallel relationship, and the catalytic combustion apparatus is configured in such a manner that in each arbitrary section which is vertical to the upstream surface and downstream surface of the catalyst combustion portion 5 and which is, at the same time, vertical to the direction of flow of a heat medium in the heat medium passage 7, each section of the catalyst combustion portion 5, radiant heat-receiving portion 9, heat exchange portion 3 and heat medium passage 7 has always the same shape.

Furthermore, because the two end surfaces of the heat exchange portion 3 which are vertical to the upstream surface and downstream surface of the catalytic combustion portion 5 and which are, at the same time, vertical to the flow of direction of a heat medium in the heat medium passage 7 are in an open condition, it is possible to integrally manufacture the radiant heat-receiving portion 9, heat exchange portion 3, catalysis support 6 and support of heat medium passage 8 by extrusion modeling. Incidentally, the radiant heat-receiving portion 9, heat exchange portion 3, catalyst support 6 and support of heat medium passage 8 constitute a casing of the invention.

In addition, because there is provided the catalyst support 6 to fix the catalytic combustion portion 5 in position, it is easy to position the catalytic combustion portion 5 and the construction of a seal between the heat exchange portion 3 and the catalytic combustion portion 5 is also simple, it is possible to raise the production efficiency during manufacturing. Therefore, a low-cost, high-mass-productivity catalytic combustion apparatus can be realized. Incidentally, the seal construction between the heat exchange portion 3 and the catalytic combustion portion 5 is as shown in FIG. 1B. This seal 100 contributes to tightening and has also the effect of suppressing thermal conduction.

Furthermore, one end surface of the heat exchange portion 3 which is vertical to the upstream surface and downstream surface of the catalytic combustion portion 5 and which is, at the same time, vertical to the direction of flow of a heat medium in the heat medium passage 7 is provided with the detachable side plate of heat exchange portion 11. Therefore, when an abnormal condition such as a deterioration or a crack in the catalyst combustion portion 5 is detected, only the catalytic combustion portion 5 can be replaced by detaching and attaching the side plate of heat exchange portion 11. In order to facilitate this replacement, it is preferable that also the upstream surface and downstream surface of the catalytic combustion portion 5 be parallel to the surface of the radiant heat-receiving portion 9. In the case of a flame-type combustion apparatus, it is preferable, from the standpoint of attaching importance to convection, that the fin surface of the fin-type radiant heat-receiving portion 9 be parallel to the flow of gas. However, in the case of an apparatus which mainly uses radiant heat like a catalytic combustion apparatus, there is no problem if the upstream surface and downstream surface of the catalytic combustion portion 5 and the surface of the radiant heat-receiving portion 9 are parallel to each other, as described above.

As a result, according to the first embodiment of the invention, a catalytic combustion apparatus that permits easy maintenance can be realized. In addition, it becomes possible to recover noble metals of platinum group from the catalytic combustion portion 5 which has been replaced and a catalytic combustion apparatus of excellent recyclability can be realized.

Furthermore, because the heat exchange passage 7 is provided so as to become contact with the support of heat medium passage 8 and is not brazed directly to the heat exchange portion 3, it is easy to separate the heat exchange passage 7 and a catalytic combustion apparatus of excellent recyclability can be realized even when the heat exchange portion 3 and the heat medium passage 7 are made of different materials.

Thus, a low-cost, high-mass-productivity catalytic combustion apparatus of excellent recyclability that permits easy maintenance can be provided.

Furthermore, the following merit is obtained because the heat medium passage 7 is provided on the above-described support of heat medium passage 8 formed in the direction parallel to the upstream surface and downstream surface of the catalytic combustion portion 5 so as to come into contact with the support of heat medium passage 8. That is, as shown in FIG. 1(A), in consideration of the phenomenon of heating in the ceiling portion of the catalytic combustion portion 5, it is apparent that in this first embodiment, the temperature difference of a heat medium heated above the ceiling portion is relatively small in comparison with a case where the support of heat medium passage 8 is formed in a direction vertical to the upstream surface and downstream surface of the catalytic combustion portion 5. That is, if the support of heat medium passage 8 is formed in a direction vertical to the upstream surface and downstream surface of the catalytic combustion portion 5, the heat medium passage 7 intersects many times in the longitudinal direction of the ceiling surface, eventually resulting in a great temperature difference of the heat medium.

Incidentally, although a gaseous fuel is used in this embodiment, a liquid fuel may be used and the same effect as described above is obtained if a vaporizing portion of liquid fuel is installed. Furthermore, although the heat medium passage 7 is disposed outside the heat exchange portion 3, the heat medium passage 7 may be embedded in the interior of the heat exchange portion 3 or disposed inside the heat exchange portion 3. The same effect as described above is obtained by these modifications.

In addition, although the catalytic combustion portion 5 is disposed with the heat exchange portion 3 through an interposed ceramic sealing material 100, (FIG. 1B) which has expansibility in a high-temperature zone, it is unnecessary that a sealing material be separately interposed if the arrangement is such that the positioning of the catalytic combustion portion 5 is possible. The same effect as described above is obtained even when the shape of the catalyst support 6 is such that the catalyst support 6 comes into line contact with the catalytic combustion portion 5 in order to suppress thermal conduction to the side of the heat exchange portion 3. That is, when the seal 100 is not used, it is necessary only that as shown in FIG. 1C, the support surface of the catalyst support 6 be formed in the shape of the letter M so that the catalyst support 6 does not come into face contact with the catalytic combustion portion 5. only that as shown in FIG. 1C, the support surface of the catalyst support 6 be formed in the shape of the letter M so that the catalyst support 6 does not come into face contact with the catalytic combustion portion 5.

Moreover, in addition to the effect as described above, when the side plate of heat exchange portion 11 is formed from a metallic material of high heat ray reflectance or when the inner surface of the heat exchange portion 3 is coated with a heat resistant black coating having a heat ray absorptance of about 1, a catalytic combustion apparatus of higher heat exchange efficiency can be realized.

Embodiment 2

The second embodiment of the invention will be described below. Although the basic construction of this second embodiment is the same as the construction of the first embodiment, it differs in that passage partition plates are arranged in order to ensure that the direction of flow of a fuel-air mixture is almost parallel to the upstream surface and downstream surface of the catalytic combustion portion 5. Therefore, this difference will be mainly described.

Figure 2:
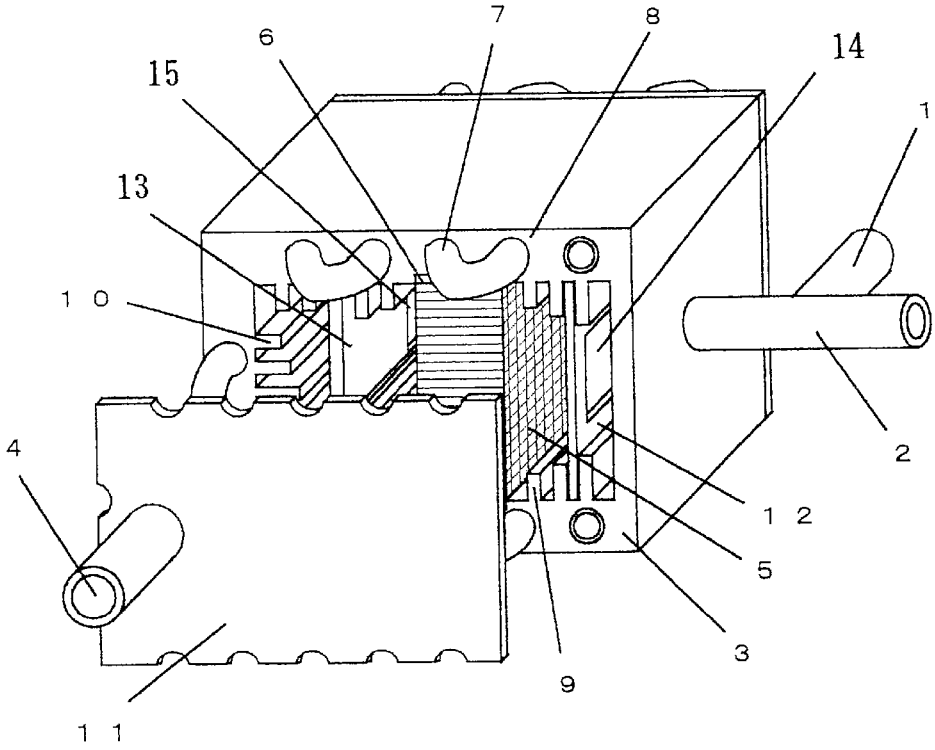
FIG. 2 is a perspective view of a catalytic combustion apparatus in the second embodiment of the invention.

FIG. 2 is a perspective view of this embodiment. In this figure, the numeral 12 indicates a first passage partition plate and the numeral 13 a second passage partition plate, the two partition plates being disposed so as to be almost parallel to the upstream surface and downstream surface of the catalytic combustion portion 5. The numeral 14 indicates an opening of first passage partition plate and the numeral 15 an opening of second passage partition plate.

Next, the operation and characteristics of this embodiment will be described with reference to FIG. 2. A fuel (a city gas in this case) which is supplied through a fuel supply line 1 is mixed with air which has passed through an air supply line 2 and is then supplied to the interior of a heat exchange portion 3.

After that, the fuel-air mixture strikes against the first passage partition plate 12, forms a stream parallel to a fin-type radiant heat-receiving portion 9, and flows into the space between the first passage partition plate 12 and a catalytic combustion portion 5 from the opening of first passage partition plate 14 (frontward in the drawing). At this point, part of the fuel-air mixture passes through the catalytic combustion portion 5 and then strikes against the second passage partition plate 13, forming a stream parallel to the second passage partition plate 13, and part of the fuel-air mixture passes through the catalytic combustion portion 5 after forming a stream parallel to the radiant heat-receiving portion 9.

At this time, the upstream temperature of the catalytic combustion portion 5 becomes 600° C. to 900° C. and the downstream temperature becomes 350° C. to 650° C. After being received by the second passage partition plate 13 disposed in the vicinity, the greater part of radiant heat from the downstream side of the catalytic combustion portion 5 is conducted through the heat exchange portion 3, passes through a support of heat medium passage 8, and is transmitted to a heat medium flowing through a heat medium passage 7, in the same manner as in the case where the radiant heat is received by the radiant heat-receiving portion 9.

A combustion waste gas flows from the opening of second passage partition plate 15 (rearward in the drawing) into the space downstream of the second passage partition plate 13, forming a stream parallel to a convective heat transfer plate 10. At this time, the combustion waste gas performs heat exchange by repeating contact with the convective heat transfer portion 10 and is eventually exhausted from an exhaust port 4 after reaching temperatures of 50° C. to 200° C. By arranging the first passage partition plate 12 and second passage partition plate 13 so that the direction of flow of the fuel-air mixture becomes substantially parallel to the upstream surface and downstream surface of the catalytic combustion portion 5, i.e., the surface of the radiant heat-receiving plate 9 and the surface of the convective heat transfer portion 10, it has become possible to increase the amount of heat transfer to the radiant heat-receiving plate 9 and the convective heat transfer portion 10 and, at the same time, to manufacture the heat exchange portion 3 by extrusion modeling in the same manner as in the first embodiment.

Furthermore, it has become possible to install the convective heat transfer portion 10 also on the most downstream surface of the heat exchange portion 3 and in this case the heat transfer area increases. Therefore, a low-cost, high-mass-productivity catalytic combustion apparatus of high heat exchange efficiency can be realized.

Also, by arranging the second passage partition plate 13 which is formed integrally with the heat exchange portion 3 near the downstream surface of the catalytic combustion portion 5, it is possible to receive the greater part of the radiant heat from the downstream side in addition to the heat transfer by convection. Therefore, a catalytic combustion apparatus of high heat exchange rate can be realized.

In addition, because the mechanical strength of the heat exchange portion 3 increases, the strength against impact by a fall during transportation etc. increases and, at the same time, an increase in yield during mass production can be expected. Therefore, a high-mass-productivity catalytic combustion apparatus can be realized.

Thus, a low-cost, high-mass-productivity catalytic combustion apparatus of high heat exchange efficiency can be provided.

Incidentally, although a gaseous fuel is used in this second embodiment, a liquid fuel may be used and the same effect as described above can be obtained if a vaporizing portion of liquid fuel is installed.

Furthermore, although the heat medium passage 7 is embedded in the interior of the heat exchange portion 3 as shown in FIG. 2, the heat medium passage 7 may be disposed outside or inside the heat exchange portion 3. The same effect as described above is obtained by these modifications.

In addition, although the catalytic combustion portion 5 is disposed with the heat exchange portion 3 through an interposed ceramic sealing material which has expansibility in a high-temperature zone, it is unnecessary that a sealing material be separately interposed if the arrangement is such that the positioning of the catalytic combustion portion 5 is possible. The same effect as described above is obtained even when the shape of the catalyst support 6 is such that the catalyst support 6 comes into line contact with the catalytic combustion portion 5 in order to suppress thermal conduction to the side of the heat exchange portion 3.

Moreover, in addition to the effect as described above, when the side plate of heat exchange portion 11 is formed from a metallic material of high heat ray reflectance or when the inner surface of the heat exchange portion 3 is coated with a heat resistant black coating having a heat ray absorptance of about 1, a catalytic combustion apparatus of higher heat exchange efficiency can be realized.

Embodiment 3

The third embodiment of the invention will be described below. Although the basic construction of this embodiment is the same as the construction of the first embodiment, it differs in that a vaporizing portion of liquid fuel is provided upstream of the catalytic combustion portion 5 and in that, at the same time, on an internal surface of the heat exchange portion 3 between the catalytic combustion portion 5 and the vaporizing portion is provided a tar holdback plate made of a material of smaller thermal conductivity than the substrate of the heat exchange portion 3. Therefore, these differences will be mainly described.

Figure 3A:
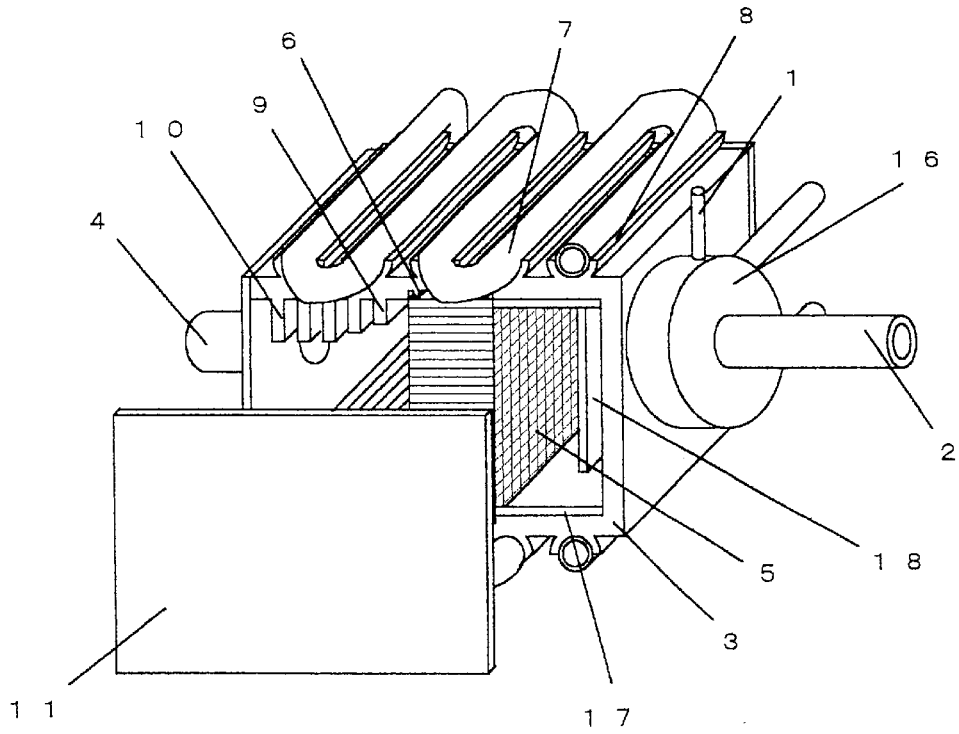
FIG. 3(A) is a perspective view of a catalytic combustion apparatus in the third embodiment of the invention.

FIG. 3A is a perspective view of this third embodiment. In the figure, the numeral 16 indicates a vaporizing portion of liquid fuel and the numeral 17 indicates a tar holdback plate, which is made of a material of smaller thermal conductivity than the substrate of a heat exchange portion 3. The numeral 18 indicates a flow equalizing plate.

Next, the operation and characteristics of this embodiment will be described with reference to FIG. 3A. A fuel (kerosene in this case) which has passed through a fuel supply line is injected into the vaporizing portion 16, where the fuel is vaporized. After that, the fuel strikes against the flow equalizing plate 18 and is mixed with air, and is then supplied to a catalytic combustion portion 5.

At this time, the upstream temperature of the catalytic combustion portion 5 is 600° C. to 900° C. and the downstream temperature is 350° C. to 650° C. A large amount of radiant heat is radiated on the upstream side of this catalytic combustion portion 5. However, because a heat medium passage 7 is provided on the heat exchange portion 3 so as to come into contact therewith, when a radiant heat-receiving portion 9 is provided on the upstream side of the catalytic combustion portion 5, the temperature of the leading end of the radiant heat-receiving portion 9 becomes about 60° C. and the liquid fuel which has vaporized condenses again, providing conditions under which tar is apt to adhere.

In this third embodiment, however, because the tar holdback plate 17 made of stainless steel having smaller thermal conductivity than aluminum, which is the substrate of the heat exchange portion 3, is provided, the surface temperature of this tar holdback plate rises to about 160° C., making it possible to suppress the adhering of tar.

Figure 3B:
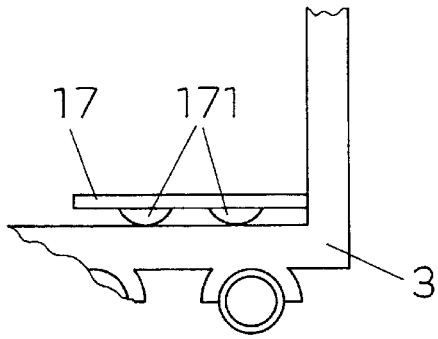
FIG. 3(B) shows partial enlarged portion of FIG. 3(A).

Furthermore, as shown in FIG. 3B, a tar holdback plate support 171 which protrudes to the side of the heat exchange portion 3 is provided under the tar holdback plate 17, bringing the tar holdback plate 17 into point contact or line contact with the heat exchange portion 3. As a result, the surface temperature of the tar holdback plate 17 rises further, making it possible to ensure that it is difficult for tar to adhere.

Thus, also in the case where the vaporizing portion 16 of liquid fuel is provided upstream of the catalytic combustion portion 5, by installing the tar holdback plate 17 made of a material of smaller thermal conductivity than the substrate of the heat exchange portion 3 on an internal surface of the heat exchange portion 3 between the catalytic combustion portion 5 and the vaporizing portion 16, it is possible to provide a catalytic combustion apparatus which is free from the fear of generation of bad odors due to tar adherence or the occurrence of ignition ascribable to tar which has accumulated, and which is excellent in amenity and safety.

Incidentally, although in this third embodiment the heat medium passage 7 is embedded in the interior of the heat exchange portion 3, the heat medium passage 7 may be disposed outside or inside the heat exchange portion 3 and the same effect as described above is obtained by these modifications.

In addition, although the shape of the catalyst support 6 is such that the catalyst support 6 comes into line contact with the catalytic combustion portion 5 in order to suppress thermal conduction to the side of the heat exchange portion 3 and sealing is performed in this line contact portion, the catalyst support 6 may be disposed with the heat exchange portion 3 through an interposed ceramic sealing material which has expansibility in a high-temperature zone. The same effect as described above is obtained even by this modification.

Although the invention was described above in examples in which the invention was embodied in catalytic combustion apparatuses using a gaseous fuel and a liquid fuel, it is needless to say that the invention is not limited to these examples. That is, cases as described below are also included in the invention.

The invention can also be applied to cases where as the types of fuels, gaseous fuels supplied from a pipeline and liquid fuels such as kerosene are used. In the case of gas fuels supplied a thigh pressures, such as liquefied gas fuels supplied from a fuel tank, it is not always necessary to add air supply means such as an air fan, and there is added means of suction and introduction of air by use of the blowout pressure of fuel gas, such as a nozzle and throat. When a liquid fuel is used, means of vaporizing the liquid fuel is added.

Although a ceramic honeycomb is used as the carrier of the catalytic combustion portion, the material and shape of the carrier are not limited so long as the material has a plurality of communicating holes through which a fuel-air mixture can flow. For example, ceramic or metallic sintered compacts, metal honeycombs, metallic non-woven fabrics, braided ceramic fibers, etc. can be used. The shape is not limited to flat plates and curved shapes, cylindrical shapes, corrugated plate shapes, etc. can be arbitrarily used according to the workability and use of the material.

As active components, it is general practice to use noble metals of platinum group, such as platinum, palladium and rhodium. Mixtures of these metals, other metals and their oxides, and mixtures with them may be used. It is possible to select active components according to the fuel type and use conditions.

Industrial Applicability

As described above, in a catalytic combustion apparatus related to the invention, its casing can be manufactured by extrusion modeling.

Furthermore, when there is provided a catalyst support which supports a catalytic combustion portion to fix the catalytic combustion portion in position, it is easy to position the catalytic combustion portion and the seal construction between a heat exchange portion and the catalytic combustion portion is simple. Therefore, it is possible to raise the production efficiency during manufacturing. For this reason, a low-cost, high-mass-productivity catalytic combustion apparatus can be realized.

In a case where an end surface of the heat exchange portion is provided with a detachable side plate of heat exchange portion, it is possible to detach and attach this side plate of heat exchange portion and only the catalytic combustion portion can be replaced when an abnormal condition, such as a deterioration or a crack, is detected in the catalytic combustion portion. Therefore, a catalytic combustion apparatus that permits easy maintenance can be realized. Furthermore, it becomes also possible to recover noble metals of platinum group from a replaced catalytic combustion portion. Thus, a catalytic combustion apparatus of excellent recyclability can be realized.

Furthermore, when a heat medium passage is provided so as to become contact with a support of heat medium passage and is not brazed to the heat exchange portion, it is easy to separate the heat medium passage, and a catalytic combustion apparatus of excellent recyclability can be realized even when the heat exchange portion and the heat medium passage are made of different materials.

When the first passage partition plate and second passage partition plate are arranged so that the direction of flow of the fuel-air mixture becomes substantially parallel to the upstream surface and downstream surface of the catalytic combustion portion, i.e., the surface of the radiant heat-receiving plate and the surface of the convective heat transfer portion, it is possible to increase the amount of heat transfer to the radiant heat-receiving plate and the convective heat transfer portion and, at the same time, to manufacture the heat exchange portion by extrusion modeling. Furthermore, it is possible to install the radiant heat-receiving portion also on the most downstream surface of the heat exchange portion and the heat transfer area increases. Therefore, a low-cost, high-mass-productivity catalytic combustion apparatus of high heat exchange efficiency can be realized.

Also, when the second passage partition plate which is formed integrally with the heat exchange portion is arranged near the downstream surface of the catalytic combustion portion, it is possible to receive the greater part of the radiant heat from the downstream side in addition to the heat transfer by convection. Therefore, a catalytic combustion apparatus of high heat exchange rate can be realized. In addition, because the mechanical strength of the heat exchange portion increases, the strength against impact by a fall during transportation etc. increases and, at the same time, an increase in yield during mass production can be expected. Therefore, a high-mass-productivity catalytic combustion apparatus can be realized.

Furthermore, in the case where the vaporizing portion of liquid fuel is provided upstream of the catalytic combustion portion, when the tar holdback plate made of a material of smaller thermal conductivity than the substrate of the heat exchange portion is installed on an internal surface of the heat exchange portion between the catalytic combustion portion and the vaporizing portion, it is possible to provide a catalytic combustion apparatus which is free from the fear of generation of bad odors due to tar adherence or the occurrence of ignition ascribable to tar which has accumulated, and which is excellent in amenity and safety.

What is claimed is:

1. A catalytic combustion apparatus comprising:

(a) a combustion chamber comprising walls, having an upstream side and a downstream side, said combustion chamber comprising;

a fuel supply portion and a combustion air supply portion on the upstream side thereof, a combustion gas exhaust port on the downstream side thereof, and a catalytic combustion portion with an upstream surface and a downstream surface, said upstream surface and said downstream surface being substantially parallel to each other;

(b) a heat exchange portion having a surface, said heat exchange portion forming part of the walls of said combustion chamber;

(c) a fin-type radiant heat-receiving portion having a surface, said fin-type radiant heat-receiving portion protruding from said heat exchange portion into said combustion chamber, and disposed in the vicinity of said catalytic combustion portion, wherein the surface of said fin-type radiant heat-receiving portion and the surface of said heat exchange portion each face in the same direction; and (d) a convective heat transfer portion, said convective heat transfer portion being provided on the downstream side of said catalytic combustion portion so as to protrude from said heat exchange portion into said combustion chamber and having a surface facing substantially in the same direction as the surface of said radiant heat-receiving portion;

wherein said heat exchange portion, said radiant heat-receiving portion and said convective heat transfer portion are integrally formed by extrusion modeling.

2. The catalytic combustion apparatus according to claim 1, wherein a surface on the side of the catalytic combustion portion faces substantially in the same direction as a surface of said radiant heat-receiving portion.

3. The catalytic combustion apparatus according to claim 1, wherein a surface of said catalytic combustion portion faces in the same direction as a surface of said radiant heat-receiving portion.

4. The catalytic combustion apparatus according to claim 1, wherein a surface on the side facing said catalytic combustion portion of said heat exchange portion is covered with a heat resistant coating of emissivity of about 1.

5. The catalytic combustion apparatus according to any one of claims 1, 2, 3, and 4, wherein said catalytic combustion apparatus further comprises a heat medium passage through which a heat medium flows and a support of heat medium passage which supports the heat medium passage, and in that said support of heat medium passage is provided on said heat exchange portion so that the direction of flow of the heat medium in said heat medium passage is substantially parallel to the surface of said catalytic combustion portion.

6. The catalytic combustion apparatus according to any one of claims 1, 2, 3, and 4, wherein said catalytic combustion apparatus further comprises a vaporizing portion which vaporizes a liquid fuel, and in that said radiant heat-receiving portion is disposed on the downstream side of said catalytic combustion portion.

7. The catalytic combustion apparatus according to claim 6 wherein upstream of said catalytic combustion portion is provided a tar holdback plate which covers a surface on the side of said catalytic combustion portion of said heat exchange portion, and which is formed from a material having a thermal conductivity smaller than that of a substrate of said heat exchange portion.

8. The catalytic combustion apparatus according to claim 7, wherein between said tar holdback plate and said heat exchange portion is provided a tar holdback plate support which comes into partial contact with both of said tar holdback plate and said heat exchange portion.

9. The catalytic combustion apparatus according to any one of claim 1, 2, 3, and 4, wherein at least one of the two walls among walls forming said combustion chamber, the two walls being substantially vertical to the surface of said radiant heat-receiving portion, is detachable.

10. The catalytic combustion apparatus according to claim 9, wherein at least one of said walls is formed from a metal or coated with a metal oxide film.

11. The catalytic combustion apparatus according to any one of claims 1, 2, 3, and 4 wherein there is a passage partition plate which is substantially parallel to the upstream surface of said catalytic combustion portion.

12. The catalytic combustion apparatus according to claim 11, wherein said passage partition plate and said wall are integrated.

13. A catalytic combustion apparatus comprising:

(a) a combustion chamber comprising walls, having an upstream side and a downstream side, said combustion chamber comprising:

a fuel supply portion and a combustion air supply portion on the upstream side thereof, a combustion gas exhaust port on the downstream side thereof, and a catalytic combustion portion with an upstream surface and a downstream surface, said upstream surface and said downstream surface being substantially parallel to each other;

(b) a heat exchange portion having a surface, said heat exchange portion forming part of the walls of said combustion chamber; and (c) a fin-type radiant heat-receiving portion having a surface, said fin-type radiant heat-receiving portion protruding from said heat exchange portion into said combustion chamber, and disposed in the vicinity of said catalytic combustion portion, wherein the surface of said fin-type radiant heat-receiving portion and the surface of said heat exchange portion each face in the same direction;

wherein:

said catalytic combustion apparatus further comprises a heat medium passage through which a heat medium flows and a support of heat medium passage which supports the heat medium passage, and said support of the heat medium passage is provided on said heat exchange portion so that the direction of flow of the heat medium in said heat medium passage is substantially parallel to the surface of said catalytic combustion portion and is substantially parallel to the surface of said fin-type radiant heat receiving portion.

14. A catalytic combustion apparatus comprising:

(a) a combustion chamber comprising walls, having an upstream side and a downstream side, said combustion chamber comprising:

a fuel supply portion and a combustion air supply portion on the upstream side thereof, a combustion gas exhaust port on the downstream side thereof, and a catalytic combustion portion with an upstream surface and a downstream surface, said upstream surface and said downstream surface being substantially parallel to each other;

(b) a heat exchange portion having a surface, said heat exchange portion forming part of the walls of said combustion chamber; and (c) a fin-type radiant heat-receiving portion having a surface, said fin-type radiant heat-receiving portion protruding from said heat exchange portion into said combustion chamber, and disposed in the vicinity of said catalytic combustion portion, wherein the surface of said fin-type radiant heat-receiving portion and the surface of said heat exchange portion each face in the same direction;

wherein:

said catalytic combustion apparatus further comprises a vaporizing portion which vaporizes a liquid fuel and is provided on the upstream side of said catalytic combustion portion, said radiant heat-receiving portion is disposed on the downstream side of said catalytic combustion portion; and upstream of said catalytic combustion portion is provided a tar holdback plate which covers a surface on the side of said catalytic combustion portion of said heat exchange portion, and which is formed from a material having a thermal conductivity smaller than that of a substrate of said heat exchange portion.

15. The catalytic combustion apparatus according to claim 14, wherein between said tar holdback plate and said heat exchange portion is provided a tar holdback plate support which comes into partial contact with both of said tar holdback plate and said heat exchange portion.

16. A catalytic combustion apparatus comprising:

(a) a combustion chamber comprising walls, having an upstream side and a downstream side, said combustion chamber comprising:

a fuel supply portion and a combustion air supply portion on the upstream side thereof, a combustion gas exhaust port on the downstream side thereof, and a catalytic combustion portion with an upstream surface and a downstream surface, said upstream surface and said downstream surface being substantially parallel to each other;

(b) a heat exchange portion having a surface, said heat exchange portion forming part of the walls of said combustion chamber; and (c) a fin-type radiant heat-receiving portion having a surface, said fin-type radiant heat-receiving portion protruding from said heat exchange portion into said combustion chamber, and disposed in the vicinity of said catalytic combustion portion, wherein the surface of said fin-type radiant heat-receiving portion and the surface of said heat exchange portion each face in the same direction;

wherein:

at least one of the two walls among walls forming said combustion chamber, the two walls being substantially vertical to the surface of said radiant heat-receiving portion, is detachable.

17. The catalytic combustion apparatus according to claim 16, wherein at least one of said walls is formed from a metal or coated with a metal oxide film.

18. A catalytic combustion apparatus comprising:

(a) a combustion chamber comprising walls, having an upstream side and a downstream side, said combustion chamber comprising:

a fuel supply portion and a combustion air supply portion on the upstream side thereof, a combustion gas exhaust port on the downstream side thereof, and a catalytic combustion portion with an upstream surface and a downstream surface, said upstream surface and said downstream surface being substantially parallel to each other;

(b) a heat exchange portion having a surface, said heat exchange portion forming part of the walls of said combustion chamber; and (c) a fin-type radiant heat-receiving portion having a surface, said fin-type radiant heat-receiving portion protruding from said heat exchange portion into said combustion chamber, and disposed in the vicinity of said catalytic combustion portion, wherein the surface of said fin-type radiant heat-receiving portion and the surface of said heat exchange portion each face in the same direction;

wherein:

there is provided a passage partition plate which is substantially parallel to the upstream surface of said catalytic combustion portion.

19. The catalytic combustion apparatus according to claim 18, said passage partition plate and said wall are integrated.

20. A method of manufacturing a casing portion of a catalytic combustion apparatus, said catalytic combustion apparatus comprising a combustion chamber having an upstream side and a downstream side, said combustion chamber comprising a fuel supply portion and a combustion air supply portion on the upstream side thereof, a combustion gas exhaust port on the downstream side thereof, and a catalytic combustion portion with an upstream surface and a downstream surface provided in said combustion chamber, said upstream surface and said downstream surface being substantially parallel to each other, said casing portion comprising a heat exchange portion, said heat exchange portion constituting part of walls of said combustion chamber, a fin-type radiant heat-receiving portion, said fin-type radiant heat-receiving portion protruding from said heat exchange portion into said combustion chamber and being provided in the vicinity of said catalytic combustion portion, and a convective heat transfer portion on the downstream side of said catalytic combustion portion so as to protrude from said heat exchange portion into said combustion chamber and having a surface facing substantially in the same direction as a surface of said radiant heat-receiving portion, in that the surface of said fin-type radiant heat-receiving portion, the surface of said heat exchange portion and the surface of said convective heat transfer portion all face in the same direction, and the method comprising the step of integrally forming said fin-type radiant heat-receiving portion, said heat exchange portion and said convective heat transfer portion by extrusion modeling.

* * * * *

UNITED STATES PATENT AND TRADEMARK OFFICE

CERTIFICATE OF CORRECTION

PATENT NO. : 6,669,469 B2
DATED : December 30, 2003
INVENTOR(S) : Motohiro Suzuki et al.

It is certified that error appears in the above-identified patent and that said Letters Patent is hereby corrected as shown below:

Title page,
Item [30], Foreign Application Priority Data, "February 21, 2002 (JP)..... 2001-044727" should read -- February 21, 2001 (JP).....2001-044727 --

Signed and Sealed this

Third Day of August, 2004

JON W. DUDAS
*Acting Director of the United States Patent and Trademark Office*